United States Patent [19]

Francis

[11] Patent Number: 4,916,812

[45] Date of Patent: Apr. 17, 1990

[54] SAFETY RAZORS MAGAZINES

[75] Inventor: John F. Francis, Woking, England

[73] Assignee: The Gillette Company, Boston, Mass.

[21] Appl. No.: 376,209

[22] Filed: Jul. 3, 1989

Related U.S. Application Data

[63] Continuation of Ser. No. 304,171, Jan. 31, 1989, abandoned.

[51] Int. Cl.[4] ..... B26B 21/24

[52] U.S. Cl. ..... 30/40; 30/86

[58] Field of Search ..... 30/40, 40.2, 86, 125, 30/47–50, 51

[56] References Cited

U.S. PATENT DOCUMENTS

| | | | |
|---|---|---|---|
| 1,767,705 | 6/1930 | Schick | 30/8.6 |
| 1,859,083 | 5/1932 | Gaisman | 30/40 |
| 2,694,856 | 11/1954 | Muros et al. | 30/86 |
| 2,734,264 | 2/1956 | Kleinman | 39/40.2 |
| 2,742,693 | 4/1956 | Nigro | 30/40 |
| 2,800,713 | 7/1957 | Roth | 30/40 |
| 2,893,118 | 7/1959 | Lewis | 30/40 |
| 3,587,170 | 6/1971 | Randol | 30/40 |
| 4,043,035 | 8/1977 | Pentney | 30/40.2 |
| 4,272,886 | 6/1981 | Asano | 30/86 |

*Primary Examiner*—Douglas D. Watts

*Attorney, Agent, or Firm*—Owen J. Meegan; Aubrey C. Brine; Scott R. Foster

[57] ABSTRACT

A safety razor incorporating blade magazines and magazines therefore, the blades being incorporated in individual units, each comprising at least one blade, carried by a support plate. A plurality of units are housed as a stack within a magazine, open at one end and providing a guard and a cap. The units are stacked in the magazine extending transversely thereof, the outermost unit being positioned at the mouth of the magazine with its blade positioned between the guard and the cap and its support plate and the magazine wall providing seal against the ingress of debris and moisture. Means are incorporated in the magazine or razor handle to eject the outermost unit from the magazine and replace it with the next unit in the stack.

15 Claims, 2 Drawing Sheets

SAFETY RAZORS MAGAZINES

This is a continuation of copending application Ser. No. 304,171, filed on Jan. 31, 1989, now abandoned.

BACKGROUND OF THE INVENTION

This invention relates to safety razors incorporating blade magazines and to the blade magazines themselves, which may be permanently associated with the razor handles or exchangeable.

There have been various proposals over many years for the provision of magazine razors for using wafer blades, although we are not aware of any of these proposals having been put into production.

The present invention is, in any event, concerned with magazines and magazine razors utilizing three-dimensional blade units, which present quite different problems in relation to effective storage and loading of the units and of sealing against the ingress of moisture into the magazine.

SUMMARY OF THE INVENTION

In a presently preferred form of the invention, the blades are incorporated in individual blade units, each comprising at least one but preferably two blades, in tandem parallel relation, carried by a support plate, a plurality of these units being housed as a stack within a magazine of generally rectangular cross-section and open at one end where the magazine provides a guard and a cap. The units are stacked in the magazine with their base plates extending transversely thereof, the outermost unit being positioned at the mouth of the magazine with its blade or blades positioned between the guard and cap, and its support plate co-operating with the walls of the magazine to seal against the ingress of debris and moisture.

Means are incorporated in the magazine and/or the handle to enable the outermost unit to be ejected from the magazine and to be replaced by the next unit in the stack.

BRIEF DESCRIPTION OF THE DRAWING

Further features of the invention will appear from the following description of the presently preferred form thereof, illustrated in the accompanying drawings, in which.

DESCRIPTION OF THE PREFERRED EMBODIMENT

Figure 1:
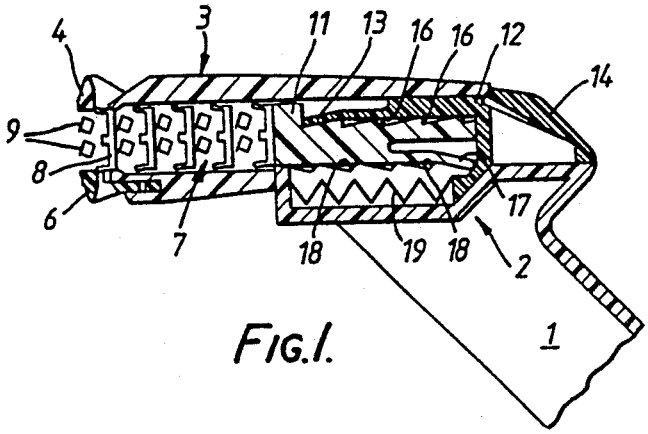
FIGS. 1, 2 and 3 are diagrammatic cross-sections showing successive stages in use of the razor.
Figure 2:
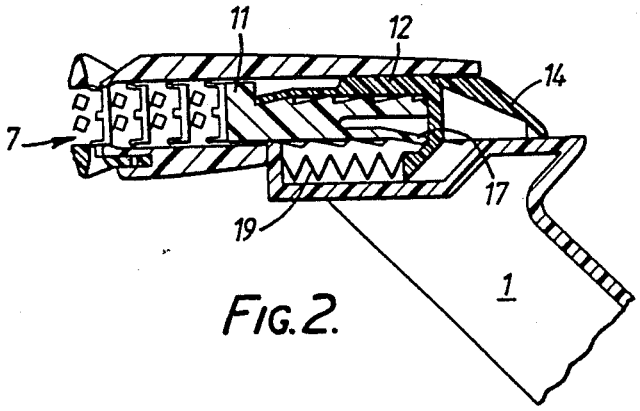
Figure 3:
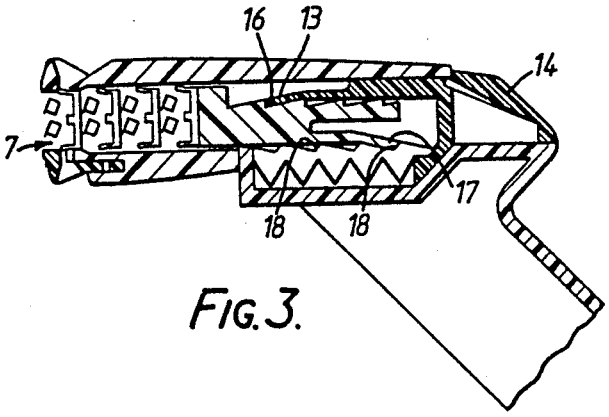

FIGS. 1 to 3 illustrate the upper portion of the razor, which has a grip or handle 1 and a head 2 to which a magazine 3 is permanently secured. The magazine is of generally rectangular cross-section and is open only at its outer end, i.e. the left-hand end as drawn. At its open end, or mouth, the magazine is formed with a cap 4 and a guard 6. The magazine houses a stack of individual blade units 7, each comprising a generally rectangular support plate 8 carrying a tandem pair of blades 9, the outermost pair of which are positioned between the cap and guard in an operative position of use.

The tandem blade pair is preferably of the form described and illustrated in the specification of co-pending UK patent application No. 8,712,785.

The support plates 8 all extend parallel with each other and transversely of the magazine. As will be explained in more detail below, each unit is precisely positioned in turn at the operative position, in which its support plate seals the interior of the magazine against the ingress of moisture and shaving debris to protect the remaining units in the stack.

The inner end of the magazine houses a plunger 11 bearing against the underside of the innermost unit, and a manually operated slide 12 whose forward end has a resilient ratchet finger 13 for engaging the plunger, and at its rear end it has a resilient latch 14 normally engaging against a fixed rear face of the magazine, to prevent inadvertent displacement of the stack. The plunger is formed with a series of ratchet teeth 16 engageable in turn by the finger 13 and it also has its own ratchet finger 17 engageable with a set of ratchet teeth 18 formed on a fixed part of the magazine. A coil compression spring 19 urges the slide to its rearmost position, as illustrated in FIGS. 1 and 3.

Starting from the position shown in FIG. 1, in which the magazine contains a full set (in this case five) of blade units, the outermost unit is employed until its edges are dulled.

It is replaced by the user pressing the slide latch 14 downwardly, to release it, and forwardly to advance the slide and plunger to the position shown in FIG. 2, in which the first unit has been ejected and the second unit located in the operative position. In the course of this movement, the plunger finger 17 picks up the next (fixed) ratchet tooth 18, and the spring 19 is compressed.

Upon release of the slide, the spring recovers to return the slide outwardly to its starting position, the slide finger 13 clicks into place to engage the next ratchet tooth 16, in readiness for the next cycle of operation, and the latch 14 snaps back into engagement with the rear face of the magazine. This condition is illustrated in FIGS. 3.

The cycle is repeatable until only the last unit remains, and when that has served its useful life, the whole razor is discarded, or if the magazine is exchangeable, it is discarded and replaced.

Figure 4:
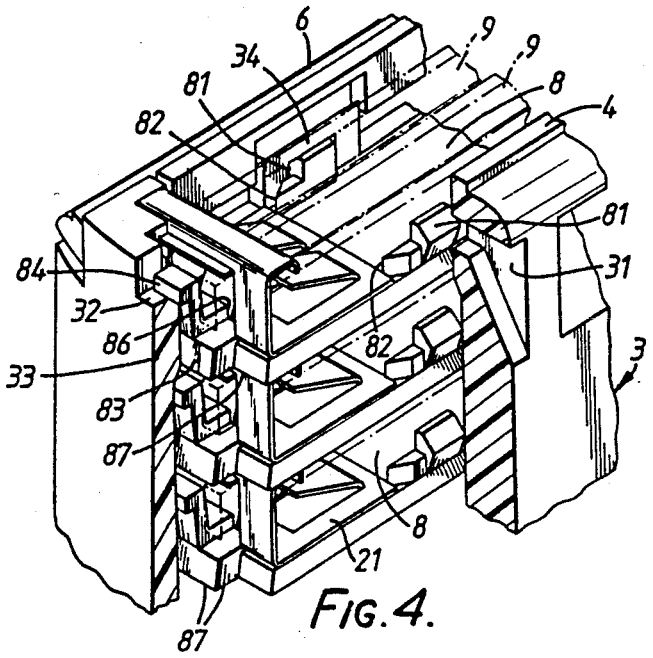
FIGS. 4 and 5 are perspective views, partially broken away, of the magazine.
Figure 5:
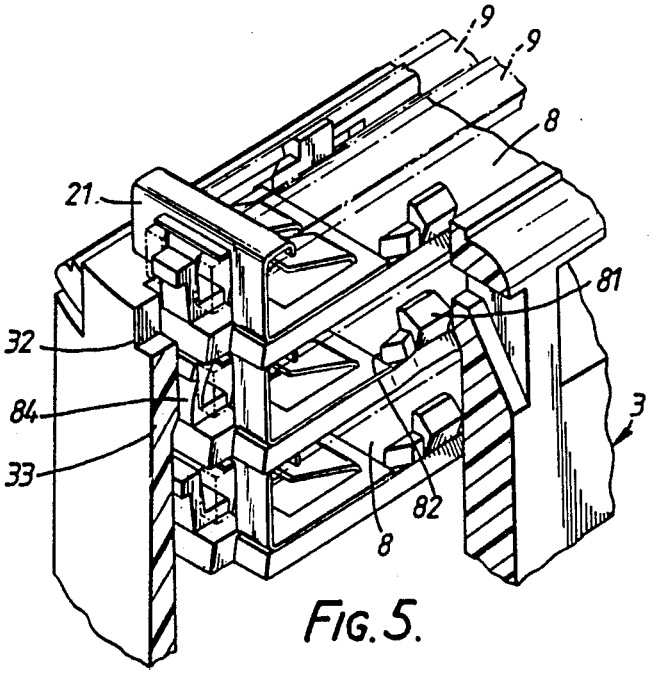

Detailed constructional features of the magazine and blade units are illustrated in FIGS. 4 and 5, in which FIG. 4 shows the outermost unit in operative position, and FIG. 5 shows that unit partially ejected.

In these Figures, the blades 9 are illustrated only in phantom line, in the interests of clarity. The blades 9 of each unit are supported at each end by metallic spring clips 21 of the form described and illustrated in the specification of copending application No. 8,212,785, which retain the blades in spaced parallel relation but permit independent resilient deflection thereof under forces encountered during shaving. Each pair of blades and clips is mounted on a support plate 8 of moulded plastic construction and of generally rectangular form, filling the cross-section of the interior of the magazine 3 near its mouth. Adjacent each end, the plate 8 has integrally moulded upstanding projections forming resilient detents 81 and location edges 82. At each end, the plate 8 has a longitudinal extension 83 and an upstanding generally Z-shaped projection constituting a resilient non-return latch 84 and providing at its inner edge a location face 86.

The adjacent clip 21 is frictionally jammed between the face 86 and the location edges 82.

The magazine 3 has, as previously stated, a cap 4 and a guard 6. In it rear wall, beneath the cap 4, it is formed with soap-slots 31 for the clearance of water and shaving debris. These slots also form fixed locations for co-operation with the adjacent blade unit detents 81.

At the front wall of the magazine, the adjacent detents 81 engage in slots formed in upstanding lugs 34 . These lugs also serve to return the guard member 6, which is formed as a separate moulding having its own longitudinal extending cantilever springs (not shown) bearing on the magazine body. The guard is held captive to the body by vertical guides (not shown) which constrain it to move vertically, i.e. perpendicular to the plane of the support plate 8. The integral springs urge the guard 6 upwardly, away from the mouth of the magazine, but it can move downwardly, against the restoring forces exerted by the cantilever springs, under the forces encountered during shaving to increase conformance of the razor to skin contours.

Small projections on the guard engage in the slots in lugs 34 to limit movement of the guard relative to the magazine.

The shorter end walls of the magazine are shaped to match the profile of the support plates 8 and at their upper ends have narrow notches 32 to receive and engage the latches 84 of the uppermost unit of the stack.

As seen in FIG. 1, the uppermost blade unit, in its operative position, is held firmly in its desired position relative to the cap and guard by the engagement of the detents 81 in the soap-slots 31 and slotted lugs 34.

It will be understood that in use of the razor, there are no forces acting on the unit which tend to eject it or partially eject it.

Forces encountered during shaving act essentially inwardly of the unit and these forces are reacted positively by engagement of the latches 84 in notches 32.

When the stack of units is pressed outwardly by operation of the slide and plunger, as previously described, the detents 81 are resiliently cammed inwardly to clear the soap slots 31 and lugs 34 as the unit is displaced upwardly. FIG. 5 shows the unit partially ejected, with the next unit progressing towards the operative position. In this region, the adjacent end wall of the magazine has a thickened cam portion 33, which cams the latch 84 inwardly. When the latch reaches the notch 32, it snaps back into its normal position to lock the unit against return movement. The latches are only required to deflect inwardly a they pass over the thickened cam portions 33 in order to avoid strain and additional friction while the units are beneath that region of the magazine.

As seen in FIGS. 4 and 5, the side faces of each support plate 8 are slightly chamfered downwardly and outwardly so as to have essentially line contact, all along the profile of the plate, with the interior wall surfaces of the magazine in the region of its mouth. The chamfering results in the lower edges 87 being slightly resilient so as to conform more readily with the magazine walls to assist in forming a moisture-tight seal.

The above described arrangement facilitates the provision of a very compact magazine, utilizing twin bladed units, with due regard to the effective storage, positioning for use and successive replacement of the units in the magazine, as well as protection of the blade edges against mechanical damage and of the units against the ingress of moisture and shaving debris.

These advantages and features flow in part from the provision on the magazine, of the cap, guard and soap slots, and on the unit of the support plates which form supports for the blades, and also close off the magazine, below the soap slots, to seal it against the ingress of moisture and shaving debris.

Furthermore, the simple rectilinear motion required to eject units and move fresh units into operative position permits the associated mechanism to be constructed in a simple manner, with a high degree of reliability.

While it is apparent that changes and modifications can be made within the spirit and scope of the present invention, it is my intention, however, only to be limited by the appended claims.

As my invention, I claim:

1. A blade unit magazine for a magazine type safety razor, the magazine being of generally rectangular cross-section and open at one end, at which the magazine is provided with a cap and a guard, and a plurality of razor blade units housed as a stack within the magazine, each unit comprising at least one razor blade secured by mounting means above an imperforate support plate, the outermost unit of the stack being located at the open end of the magazine, with its blade or blades positioned between the cap and guard and with its support plate cooperating with the walls of the magazine to seal against the ingress of debris and moisture, feeding means being provided in the magazine and/or in the razor to enable the outermost unit in the stack to be ejected from the magazine and to be replaced by the next unit in the stack.

2. A blade unit magazine according to claim 1 wherein the said feeding means comprises a manually operable plunger engageable with the innermost unit of the stack, the said units bearing directly against each other for transmitting forces from the plunger through the stack.

3. A blade unit magazine according to claim 2 wherein the plunger is advanced stepwise through a first ratchet arrangement and a second ratchet arrangement prevents reverse movement of the plunger after each advance.

4. A blade unit magazine according to claim 1 wherein each said support plate is provided with resilient detent means which co-operated with portions of the magazine when the plate reaches the outermost position to retain the unit firmly in that position, the detent means being disengaged by a subsequent operative movement of the plunger.

5. A blade unit magazine according to claim 4, wherein the detent means on each unit include latches including outwardly directed projections which snap into co-operating recesses in the adjacent walls of the magazine to lock the outermost unit against return movement inwardly of the magazine.

6. A blade magazine according to claim 4 wherein the edges of each plate and the detent means are spaced from the walls of the magazine until the unit arrives at the outermost position.

7. A blade unit magazine according to claim 1 wherein the peripheral edges of each support plate are chamfered, so as to be resiliently deformeable and to have substantially live contact with the walls of the magazine when each unit is in the outermost position.

8. A blade unit magazine according to claim 1 wherein the said guard is mounted for limited movement, relative to the support plate of the outermost movement, against the action of a resilient restoring force in directions perpendicular to the plane of the said support plate.

9. A blade unit magazine according to claim 1 wherein each unit comprises a blade or a tandem pair of blades and the said mounting means incorporate resilient means which permit limited movement of the blade or blades towards and away from the support plate under the action of forces encountered during shaving.

10. A blade unit magazine according to claim 3 wherein each said support plate is provided with resilient detent means which co-operate with portions of the magazine when the plate reaches the outermost position to retain the unit firmly in that position, the detent means being disengaged by a subsequent operative movement of the plunger.

11. A blade unit magazine according to claim 10 wherein the detent means on each unit include latches including outwardly directed projections which snap into co-operating recesses in the adjacent walls of the magazine to lock the outermost unit against return movement inwardly of the magazine.

12. A blade unit magazine according to claim 11 wherein the edges of each plate and the detent means are spaced from the walls of the magazine until the unit arrives at the outermost position.

13. A blade unit magazine according to claim 12 wherein the peripheral edges of each support plate are chamfered, so as to be resiliently deformeable and to have substantially live contact with the walls of the magazine when each unit is in the outermost position.

14. A blade unit magazine according to claim 13 wherein the said guard is mounted for limited movement, relative to the support plate of the outermost movement, against the action of a resilient restoring force in directions perpendicular to the plane of the said support plate.

15. A blade unit magazine according to claim 14 wherein each unit comprises a blade or a tandem pair of blades and the said mounting means incorporate resilient means which permit limited movement of the blade or blades towards and away from the support plate under the action of forces encountered during shaving.

* * * * *